United States Patent [19]

Rogers

[11] Patent Number: 4,969,566

[45] Date of Patent: Nov. 13, 1990

[54] HOLDING CLOSURE

[76] Inventor: Grafton D. Rogers, 500 W. University Pkwy., Apt. 14-D, Baltimore, Md. 21210

[21] Appl. No.: 371,617

[22] Filed: Jun. 26, 1989

[51] Int. Cl.[5] ..... B65D 39/00

[52] U.S. Cl. ..... 215/287; 215/273; 215/294; 215/316; 215/354

[58] Field of Search ..... 215/287, 354, 320, 329, 215/290, 292, 294, 316

[56] References Cited

U.S. PATENT DOCUMENTS

| | | | |
|---|---|---|---|
| 163,026 | 5/1875 | Murray | 215/294 |
| 905,431 | 12/1908 | Hunt, Jr. | 215/294 |
| 1,144,919 | 6/1915 | Shuck | 215/294 |
| 1,329,248 | 1/1920 | Larkin | 215/329 X |
| 1,805,257 | 5/1931 | Pitt | 215/354 X |
| 2,396,337 | 3/1946 | Moore | 215/292 X |
| 2,638,613 | 5/1953 | Gunther | 215/320 X |
| 3,269,576 | 8/1966 | Law | 215/354 X |
| 3,599,821 | 8/1971 | Eggert | 215/320 X |
| 3,780,897 | 12/1973 | Wassilieff | 215/320 X |
| 4,487,326 | 12/1984 | Uhlig | 215/320 X |

FOREIGN PATENT DOCUMENTS

| | | | |
|---|---|---|---|
| 253841 | 6/1961 | Australia | 215/320 |
| 497328 | 12/1950 | Belgium | 215/320 |
| 523230 | 10/1953 | Belgium | 215/320 |
| 360819 | 5/1906 | France | 215/320 |
| 1273666 | 9/1961 | France | 215/320 |
| 464561 | 5/1951 | Italy | 215/320 |
| 54020 | 6/1934 | Norway | 215/320 |
| 312011 | 5/1929 | United Kingdom | 215/290 |

*Primary Examiner*—Stephen Marcus

*Attorney, Agent, or Firm*—Walter G. Finch

[57] ABSTRACT

Several embodiments of a novel closure are disclosed for closing and/or opening the neck of a container of the semi-rigid type. The first embodiment of the closure consists of a top having a elastic spring with a plurality of prongs for holding a closure top to the inside of the container. In the second and third embodiments of the closure, an elastic bulbous insert or compressible substantially wedge shaped or cylindrical shaped inserts are used to seal the opening of the container. In the fourth embodiment of the invention, use is made of a closure having spaced peripheral flanges in a ring with bulbous or straight ends for sealing a rigid type container.

8 Claims, 2 Drawing Sheets

HOLDING CLOSURE

BACKGROUND AND SUMMARY OF THE INVENTION

This invention relates generally to containers, and more particularly to a device for temporarily holding a closure of a container in operative position.

For a long time there has not been any economical device developed to temporarily close the top of a container after some of the contents of the container have been dispensed, and then allow for further quick and easy access to the contents of the container as the contents are desired, such as in flexible containers holding drugs, medicines and toothpaste, or in rigid containers such as jelly jars and the like.

One of the objects of this invention is to provide a device by which the closure, cover, and/or cap of a flexible as well as a rigid container storing contents, such as fluid and/or semi-fluid contents can be temporarily sealed after a portion of the contents have been dispensed.

And another object of this invention is to provide a unique closure device for rigid and semi-rigid containers which can be made to secure a closing fit as needed to protect the contents of a container almost as perfectly as the original closure, cap, or cover, and still allow easy access to the contents of the closure.

A further object of this invention is to provide a closure device for rigid and semi-rigid containers that lessens the danger of losing the closure device cover, and/or cap after removal of a portion of the contents of the container needed at the moment by the user thereof.

Still another object of this invention is to provide an economical device by which the closure, cover, or cap of container storing contents to be dispensed, such as a tube of tooth paste or jar of jelly, can be held in operative position to cover the opening of the container temporarily until further partial dispensing of the contents from the container is desired.

And still even a further object of this invention is to provide a temporary device for closing the opening of a container so that quick and easy access can be had to the contents of the container periodically without the use of any semi-permanent covering device and/or closure such as a screw-top, metal clamp and/or plastic tape.

Still a further object of this invention is to provide a rapid connect, disconnect device for sealing and/or unsealing the dispensing opening of a container having contents stored therein for dispensing these contents periodically as desired.

And another object of this invention is to provide a closure device for containers which fits into conventional flexible or rigid containers without any change to the closure or container.

Still another object of this invention is to provide a closure type device for containers of the flexible and/or rigid type which does not interfere with, and is just as effective with the use of any arrangement of semi-permanent closures.

Another and a still further object of this invention is to provide a closure device for rigid and unrigid containers which can be removed from a container and easily replaced to give quick access to the contents of the container.

To provide a closure device for containers that does not add any significant weight or bulk to the container to which it is applied, is another object of this invention.

In summary, this invention relates to a unique closure for closing the opening in a rigid as well as a non-rigid container such as a jar or toothpaste container, respectively, or similar type containers for holding contents to be partially and periodically dispensed.

In one embodiment of the invention for use with semi-rigid and/or flexible containers, the closure means consists of an elastic spring attached to the closure means and having a plurality of spaced prongs for engaging the inside surface of the container opening. As a second embodiment of the invention, the closure means consists of a bulbous shaped insert for closing the opening in the container, while in the third embodiment of the closure means, a wedge-shaped or substantially cylindrical shaped wedge is utilized for sealing the container opening.

For rigid containers such as jars or bottles, a fourth embodiment of the invention consists of a ring fitted inside the rim of the cover of the jar or bottle at a distance equal to the thickness of the container. This ring is composed of a compressible substance, such as rubber or plastic. It has a bulbous or other desired shape at its free edge and is positioned so that the bulbous edge or edges will impinge on the inside of the opening of the container and will effectively seal the container when the cover is pushed over the opening.

BRIEF DESCRIPTION OF THE DRAWINGS

These and other objects and attendant advantages of this invention will become more obvious from the following drawings and detailed description of the invention wherein.

DESCRIPTION OF THE PREFERRED EMBODIMENTS

This invention is illustrated in connection with closing and sealing toothpaste containers. However, it can be readily adapted on other types of containers for holding medicines, food, or cosmetics and in containers of either flexible or rigid type.

Figure 1:
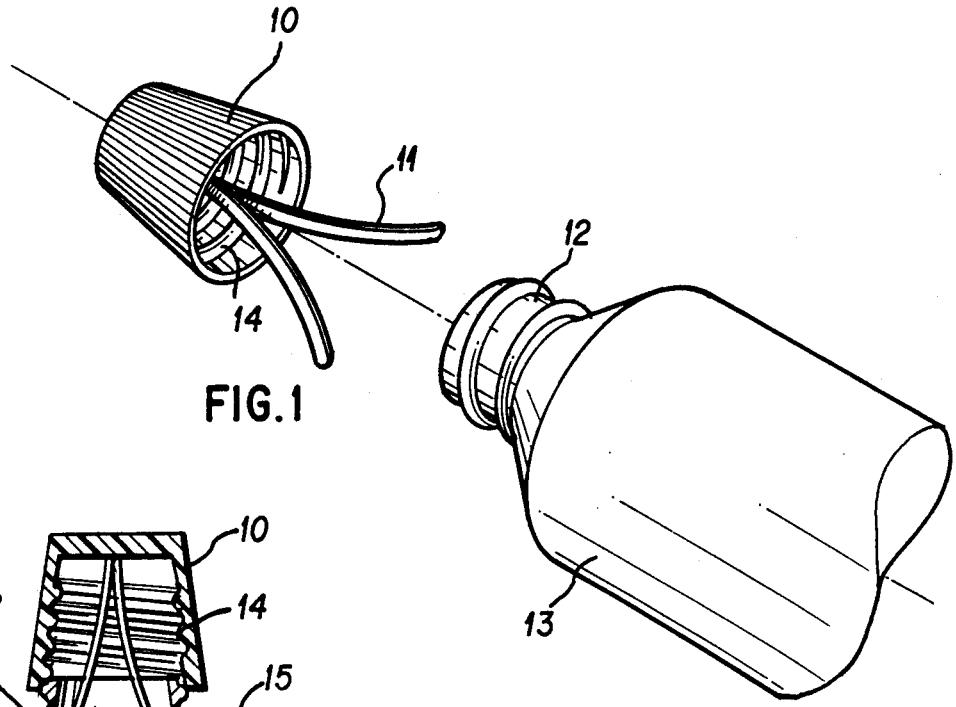
FIG. 1 is an exploded perspective view of a toothpaste container incorporating a first embodiment of the closure device of this invention.
Figure 2:
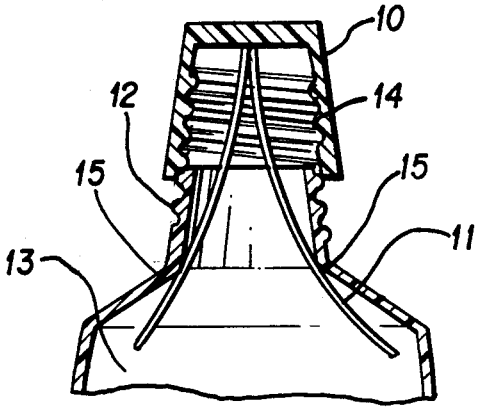
FIG. 2 is a side sectional view of the cap and/or closure of the toothpaste container of FIG. 1 incorporating the closure device of this invention.

Referring now to FIGS. 1 and 2 of the drawings, there is shown a toothpaste container 13 having a cap 10 fitted with a narrow split metal spring 11 having two prongs. The two prongs of the spring 11 can be compressed to enter the opening 8 of the container 13. The elastic flexibility of the spring 11 causes the two prongs of the spring 11 to spread apart so that they impinge on the sides of the mouth opening of the container 13 at point 15, shown best in FIG. 2, thus drawing the cap 10 down on the opening 8 of tube 13 and holding it securely in position without the use of the screw-threads 12 and 14 of the container 13 and cap 10, respectively, (which are usually used to secure the cap 10) or any other device.

Figure 3:
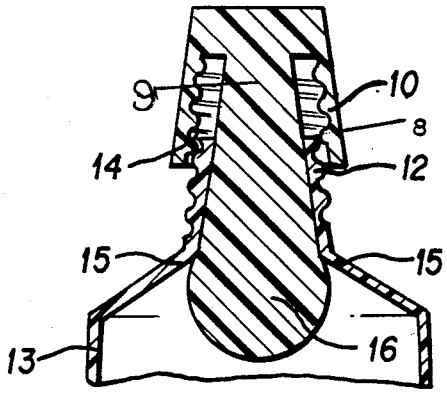
FIG. 3 is a side sectional view of at toothpaste cap for a toothpaste container incorporating a second embodiment of the closure device of this invention.

Referring now to FIG. 3 of the drawings, there is shown a similar type of container 13 as shown in FIGS. 1 and 2 with a closure device 9 but instead of the split metal spring 11, the expanding holding action is secured by a compressible bulbous shaped insert 16 provided in the cap 10. This compressible bulbous shaped insert 16 can be squeezed into the opening 8 of the tube 13. On the inside of the top opening 8 of tube 13, the insert 16 expands to impinge on the sides of the tube 13 generally at point 15 and thus produces the same holding effect as the spring 11 in FIGS. 1 and 2 without the use of the screw threads 12 and 14 or any other closure device.

Figure 4:
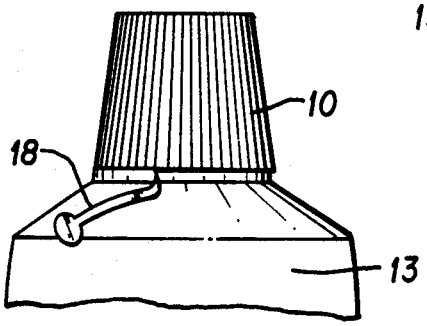
FIG. 4 is a side view of a toothpaste cap showing a tape seal, the removal of which would require the use of this invention to hold the cap in an operative position.
Figure 5:
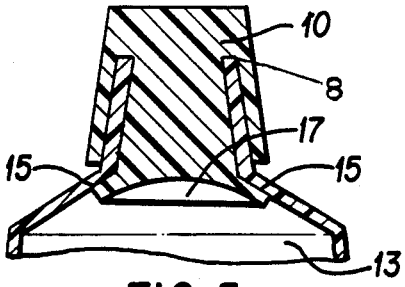
FIG.5 is a side longitudinal sectional view of a toothpaste cap illustrating a third embodiment of a closure device of this invention, without the use of a screw thread for the container cap and with an insert of a different shape.

FIGS. 4 and 5 illustrate a third embodiment of the invention as applied to the cap 10 of the toothpaste container 13. This cap 10, in this instance, is attached to the top opening 8 of the container 13 by a tape 18 instead of threads, so that when the tape is removed, the cap 10 must necessarily be held in position by a similar compressible insert 17, shown in FIG. 5. This insert 17 is substantially cylindrical but of wedge shape to illustrate that the inserts 17 and 16, as shown in FIG. 3 can be formed of different shapes and where the contents are of a thick consistency. It can even be of plain cylindrical shape because suction will hold the cap sufficiently in place. This insert 17 expands in the top opening 8 of the tube or container 13 so as to impinge at point 15 and hold the cap 10 in place without the use of the tape 18, screw threads 12 or any other device.

Figure 6:
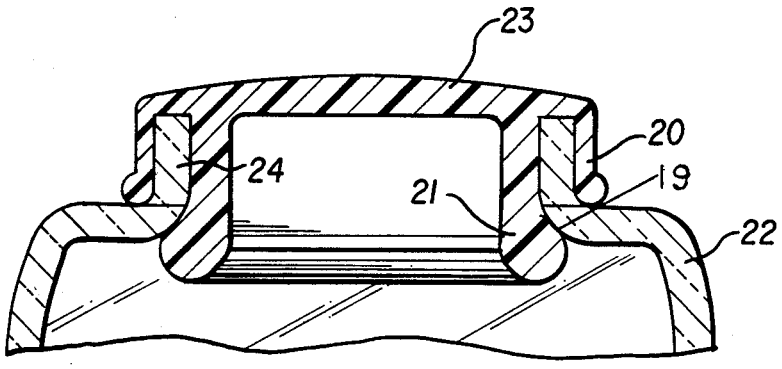
FIG. 6 is a side longitudinal sectional view of a fourth embodiment of a closure device of this invention for temporarily closing a container where the opening is without screw threads.
Figure 7:
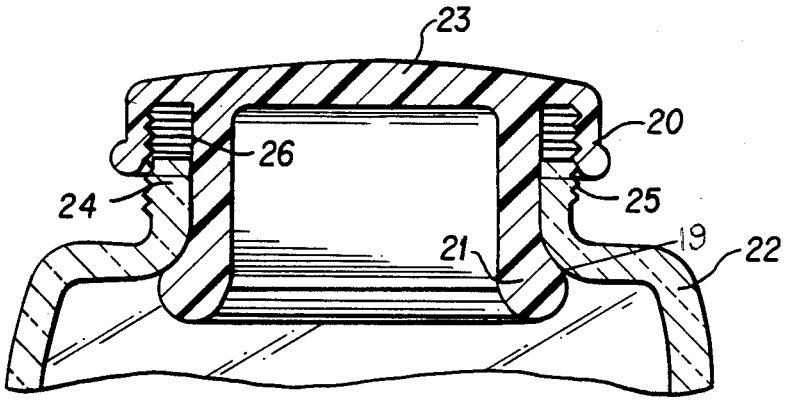
FIG. 7 is a side longitudinal sectional view of the fourth embodiment of the closure device of this invention with a screw top container.

Referring now to FIGS. 6 and 7 of the drawings, there is illustrated how the invention can be applied to the temporary securing of a cap 23 on the opening of a rigid or semi-rigid jar 22, or other similar containers, either having a screw-on top as shown in FIG. 7 or without such a top, that is, a top without threads as illustrated in FIG. 6.

This is achieved by inserting a compressible ring 21 in the cap 23 a distance inside the outside rim 20 equal to the thickness of the wall 24 of the container 22. Ring 21 should be so formed that its outside edge bulges slightly so that when the top is pushed into the mouth 24 of the container 22, the bulging edge thereof will impinge on the inside of the mouth 24 at the point 19 to hold the cap 23 securely in place, without the use of the screw-threads 25 and 26, of FIG. 7 or any other device.

It is to be noted that the compressible inserts of 16, 17 of FIGS. 3 and 5, as well as the rings 21 of FIGS. 6 and 7, can be formed of any suitable elastic material, such as rubber, plastic or similar materials.

Obviously many modifications and variations of the present invention are possible in the light of the above descriptions. It is therefore to be understood that within the scope of the appended claims the invention may be practiced otherwise than as specifically described.

What is claimed is:

1. A removable and reusable closure for a container having an opening for receiving, storing, and dispensing contents therefrom, comprising, a container having an opening, a closure means for opening and/or closing the opening of said container, said closure means including a cap element and a retaining element, first sealing means on said cap element, means on said container for cooperating with said first sealing means on said cap element to secure said closure means in a fully seated position in said opening of said container, said retaining element on said closure means cooperating with said container and said cap element to retain said closure means in a less fully sealed position on said container but still retaining a seal between said cap element and said container to close said opening of said container.

2. A removable and reusable closure for a container having an opening for receiving, storing and dispensing contents therefrom as recited in claim 1, wherein said first sealing means consists of threaded elements, and said cooperating means on said container is provided with threaded elements arranged to cooperate with the threaded elements of said cap element to fully seal said closure means to said container to close said opening in said container.

3. A removable and reusable closure for a container having an opening for receiving, storing and dispensing contents therefrom as recited in claim 1, wherein said retaining element consists of at least a pair of prongs attached at corresponding end thereof to said cap element and splayed throughout their length and formed of concaved shape and extending outwardly along the longitudinal axis of said container when in operative position.

4. A removable and reusable closure for a container having an opening for receiving, storing and dispensing contents therefrom as recited in claim 3, wherein said pair of prongs are formed of elastic material and engage the inside surface of said container through spring action to retain said closure means in a less than fully sealed position on said container but still retaining a seal between said cap element and said opening of said container to close said container.

5. A removable and reusable closure for a container having an opening for receiving, storing and dispensing contents therefrom as recited in claim 1, wherein said retaining element consists of an expandable bulbous shaped insert for engaging the inside surface of said opening of said container for holding said closure means in a temporary operative position on said container.

6. A removable and reusable closure for a container having an opening for receiving, storing and dispensing contents therefrom as recited in claim 1, wherein said retaining element is formed of a compressible material for engaging the inside surface of said opening of said container for retaining said closure means cooperating with said container in a less fully sealed position but still retaining a seal between said cap element and said opening of said container and to close said opening of said container.

7. A removable and reusable closure for a container having an opening for receiving, storing and dispensing contents therefrom as recited in claim 1, wherein said container has a neck, said cap element being provided with spaced outer and inner longitudinally extending shoulders around the periphery thereof spaced apart a distance substantially equal to the cross section of said container and extending longitudinally of said closure means and said container when in operative position and for being positioned over the neck of said container, the outer shoulder of said cap element constituting said first sealing means, the outer surface of said neck of said container constituting said cooperating means on said container, and the inner shoulder being said retaining means and being arranged to engage and cooperate with the inner surface of said neck of said container to retain said closure element in a less than fully sealed position but still retaining a seal between said closure means and said opening of said container.

8. A removable and reusable closure for a container as recited in claim 7, wherein the free ends of said longitudinally extending shoulders are of bulbous shape for engaging the inner neck surface of said container.

* * * * *